US009757727B2

(12) United States Patent
Manalis et al.

(10) Patent No.: US 9,757,727 B2
(45) Date of Patent: Sep. 12, 2017

(54) HYDRODYNAMIC TRAP ARRAY

(71) Applicant: Massachusetts Institute of Technology, Cambridge, MA (US)

(72) Inventors: Scott R. Manalis, Cambridge, MA (US); Robert John Kimmerling, Cambridge, MA (US); Shijie Nigel Chou, Cambridge, MA (US); Vivian C. Hecht, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 23 days.

(21) Appl. No.: 14/714,452

(22) Filed: May 18, 2015

(65) Prior Publication Data

US 2015/0343444 A1 Dec. 3, 2015

Related U.S. Application Data

(60) Provisional application No. 62/004,274, filed on May 29, 2014.

(51) Int. Cl.
*B01L 3/00* (2006.01)

(52) U.S. Cl.
CPC . *B01L 3/502761* (2013.01); *B01L 2200/0668* (2013.01); *B01L 2300/087* (2013.01); (Continued)

(58) Field of Classification Search
CPC ..... B01L 3/502761; B01L 2300/163; B01L 2300/0816; B01L 2200/0668; B01L 2300/087; B01L 2400/0487; B01L 2400/084; B01L 2300/0883; B01L 2300/12
See application file for complete search history.

(56) References Cited

U.S. PATENT DOCUMENTS

2011/0174622 A1* 7/2011 Ismagilov ..... B01F 5/0646 204/452
2012/0183990 A1* 7/2012 Schuette ..... B01L 3/502707 435/29

FOREIGN PATENT DOCUMENTS

WO 2004038363 A2 5/2004
WO 2010147078 A1 12/2010
WO 2015002975 A1 8/2015

OTHER PUBLICATIONS

Notification of Transmittal of the International Search Report and the Written Opinion of the International Searching Authority, or the Declaration, for PCT/US2015/031716 mailed on Aug. 10, 2015.

* cited by examiner

*Primary Examiner* — Lore Jarrett
(74) *Attorney, Agent, or Firm* — Sam Pasternack; MIT Technology Licensing Office

(57) ABSTRACT

Hydrodynamic Trap Array. The array includes a serpentine bypassing channel including a plurality of trapping pockets disposed therein, the trapping pockets including a ramp entry portion to decrease flow velocity orthogonal to the trapping pocket to increase trapping efficiency. The relative fluid resistances of the trapping pockets and the serpentine bypassing channel are selected such that a slight majority of the flow is diverted to one of the trapping pockets. A pair of microfluidic bypass channels flank the array of traps allowing independent control of upstream and downstream pressures on each side of the array, thereby decoupling flow magnitude in the bypass channels from flow across the trapping pockets.

3 Claims, 3 Drawing Sheets

(52) U.S. Cl.
CPC ..... *B01L 2300/0816* (2013.01); *B01L 2300/0883* (2013.01); *B01L 2300/12* (2013.01); *B01L 2300/163* (2013.01); *B01L 2400/0487* (2013.01); *B01L 2400/084* (2013.01)

HYDRODYNAMIC TRAP ARRAY

This application claims priority to provisional application No. 62/004,274 filed on May 29, 2014, the contents of which are incorporated herein by reference.

This invention was made with government support under Grant Nos. R01 CA170592 and R01 GM085457, awarded by the National Institutes of Health. The Government has certain rights in the invention.

BACKGROUND OF THE INVENTION

This invention relates to a hydrodynamic trap array for long-term single-cell lineage characterization.

It is desirable to be able to capture or trap single cells for the purpose of determining the total time for a single cell cycle as well as to maintain mother-daughter relationships between a single cell's progeny for several generations.

An object of the invention is a microfluidic device that will trap single cells, and as the cell proliferates, will trap its progeny in subsequent traps.

SUMMARY OF THE INVENTION

According to the invention, the array of microfluidic hydrodynamic traps includes a serpentine bypassing channel including a plurality of trapping pockets disposed therein. The trapping pockets include a ramp entry portion to decrease flow velocity orthogonal to the trapping pocket to increase trapping efficiency. The relative fluid resistances of the trapping pockets and the serpentine bypassing channel are selected such that a slight majority of the flow is diverted to one of the trapping pockets. A pair of microfluidic bypass channels flank the array of traps and in fluid communication therewith for independent control of upstream and downstream pressures on each side of the array, thereby decoupling flow magnitude in the bypass channels from flow across the trapping pockets. In a preferred embodiment, the surfaces of the serpentine bypassing channel are passivated. The surfaces may also be native silicon.

DESCRIPTION OF THE PREFERRED EMBODIMENT

Figure 1:
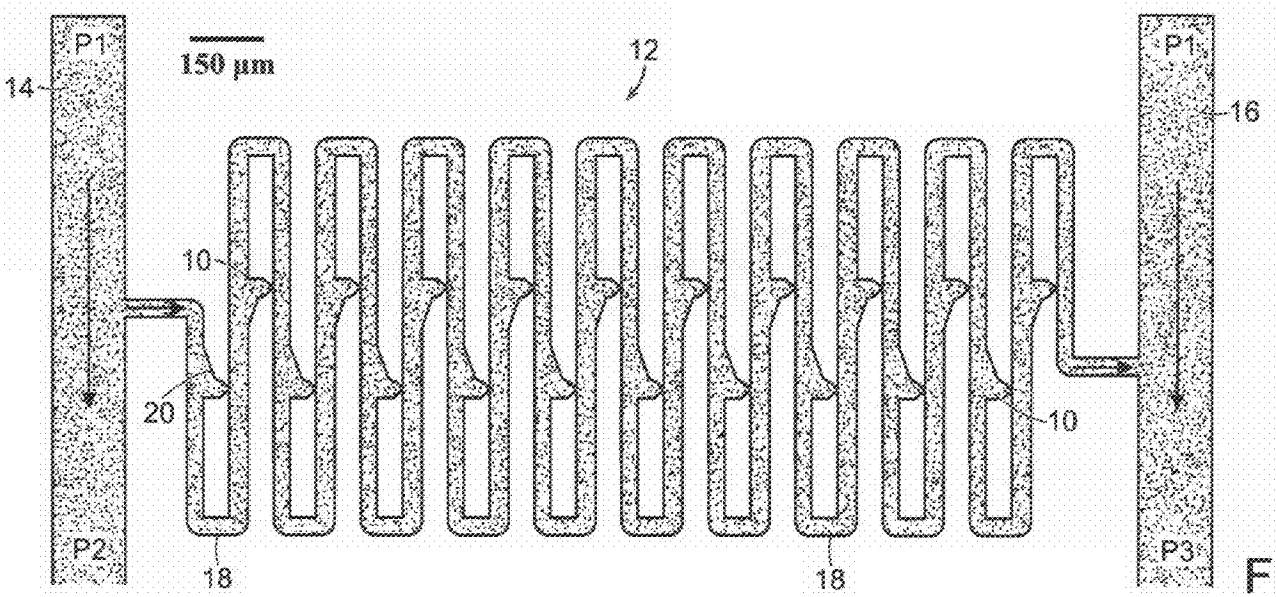
FIG. 1 is a schematic illustration of an array of microfluidic hydrodynamic traps with independent control of upstream and downstream pressures.

The device according to the invention consists of microfluidic hydrodynamic traps 10 which allow for the high efficiency capture of single particles or cells (FIG. 1). These traps 10 are arranged in an array 12 such that we can capture a single cell upstream (left-most trap) and as the cell proliferates its progeny flow downstream and are captured by subsequent traps. These arrays 12 of hydrodynamic traps 10 are flanked by microfluidic bypass channels 14 and 16 which allow for independent control of upstream and downstream pressures on either sides thus decoupling the flow magnitude in the bypass channels 14 and 16 from the flow across the traps 10 and thus the cells.

Figure 2:
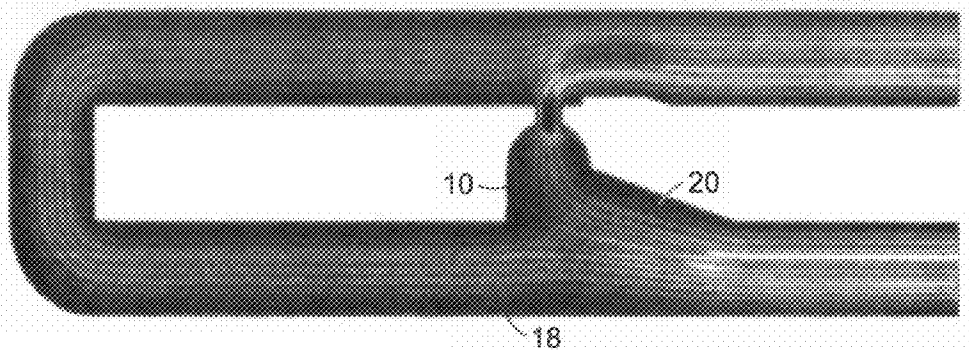
FIG. 2 is a flow simulation of a hydrodynamic trap showing the fraction of flow directed to the trapping pocket as well as to the bypassing serpentine channel.

The hydrodynamic traps 10 disclosed herein were designed to have a sensitive balance of hydrodynamic resistances between the trapping pocket 10 and the bypassing serpentine channel 18 (FIG. 2). This design ensures that prior to cell capture a slight majority of the flow at the trap junction is diverted to the trapping pocket. However, once a single cell is captured the resistance of the trapping pocket increases and any subsequent cells are diverted to the bypassing serpentine channel 18 thus avoiding multiple cell capture in a single trap. The efficiency of trapping only a single cell increases with a closer fluidic resistance balance between the trap and bypass serpentine 18.

This sensitive resistance balance yields a lower initial trapping efficiency as compared with a design which has a much higher ratio of the flow directed into the trap. To mitigate this lowered efficiency we included a ramp entrance geometry 20 to the traps 10 in order to decrease the flow velocity orthogonal to the traps as cells approach in order to increase trapping efficiency.

The bypass channels 14 and 16 which flank the array 12 of hydrodynamic traps 10 allow for decoupled flow rates in the bypass channels and across the lane of traps 10. For instance, while P1 greater than P2, P3 there will be significant flow along the bypass channels 14 and 16. However, if P2 equal P3 there will be no flow across the traps 10. This allows for a rapid change in the fluid surrounding the traps 10 without dislodging cells or squeezing them through the traps 10. This rapid buffer exchange can be used to rapidly alter the environment cells are exposed to (for instance to measure single cell drug response) as well as to conduct various single cell measurements which require buffer change events such as immunofluorescence staining.

The bypass channels 14 and 16 also ensure constant profusion of cellular growth media to the traps while minimizing the flow of media across the cells and thus reducing the sheer stress the cells experience. This growth media is pressurized with 5% $CO_2$ and as such maintains long term pH stability. Furthermore, the device is mounted on a clamp with re-circulating water held at 37 degrees Celsius in order to maintain temperature stability. With all of these conditions maintained we are able to grow single cells for several generations in these devices.

Suspension Cells:

for suspension (non-adherent) cell types we are able to load a few single cells in the upstream traps 10 of the array 12. As these cells grow and proliferate their progeny are shed and, due to a slight pressure drop (P2–P3) applied across the traps, these daughter cells are carried downstream to the next unoccupied trap 10. By conducting time-lapse microscopy of these cells as the proliferate we are able to determine the total time for a single cell cycle as well as maintain mother-daughter relationships between a single cell's progeny for several generations.

Adherent Cells:

Adherent cells are lifted from bulk culture with trypsin and then seeded in the traps using the same method as the suspension cells. However, shortly after loading these cells will begin to adhere to the channel surface. As these cells grow and divide their progeny will remain adherent and thus not flow downstream as in the case of a suspension cells. In this case we still conduct time-lapse microscopy to determine cell cycle timing as well as lineage information. However, after a few rounds of division we introduce trypsin to the cells via the bypass channel in order to detach them from the channel surface. By applying a slight pressure drop across the traps during this trypsinization we are able to flow these lifted cells downstream for secondary capture. By imaging this process we can maintain the lineage information gathered by time-lapse microscopy and once the cells are passed downstream can continue the proliferation measurements.

In order to effectively grow suspension cells in these devices without significant sticking we passivate the channel surfaces with PLL-g-PEG whereas for adherent cell growth we use a native silicon surface to promote adhesion. This surface treatment can also be modified while cells are trapped. For instance, we are able to grow adherent cells for multiple generations and subsequently detach them from the surface with trypsin. Once the cells are detached we flush the system with a PLL-g-PEG solution and passivate the channel surface thus precluding further adhesion of the trapped cells all while maintaining the previously gathered lineage information.

This type of surface chemistry switch is particularly useful for measurements of cancer stem cells which rely on adherent cell culture followed by seeding in low-adherent conditions to determine sphere-forming cells which represent cancer stem cells. This platform offers the first method of changing these cellular growth conditions without losing lineage information of the cells grown under adherent conditions.

The bypass channel arrangement in this device also allows for the release of a single cell at a time in to the bypass channel for off-chip capture. By temporarily reversing the pressure differential across the traps (P2−P3→P3−P2) we flow cells in the opposite direction and thus out of the traps. As soon as a single cell makes it to the bypass channel the original pressure differential is re-established and the cells once again flow in to the traps. However, the single cell that made it to the bypass channel is subsequently flushed downstream with the pressure drop applied along the bypass channel (P1−P2) which is maintained for the duration of the process. This process allows for the release of a single cell at a time after long term growth and lineage measurements in the device.

With the application of a constant upstream pressure ($P1>P_{atm}$) and with both downstream ports held at atmospheric pressure ($P2=P3=P_{atm}$) if R4 has a lower fluidic resistance than R3 a larger friction of flow will be directed towards the downstream port labelled P3. To overcome this bias, the pressure can be increased at the port labelled P3 ($P3>P_{atm}$) while maintaining atmospheric pressure at the port labelled P2. The additional pressure applied to port P3 can be modulated as described above to release individual cells. This fluidic resistance balance between the bypass channels downstream of the hydrodynamic traps (R3 v. R4) thus allows for single cell release while maintaining atmospheric pressure at the downstream port used to collect cells (port labelled P2). The ability to conduct single cell collection at ambient pressures allows for the integration of this design with existing open air fluidic systems such as fraction collectors.

These designs incorporate multiple parallel lanes of hydrodynamic traps in a single device. Seeing as each lane connects with the bypass channels at slightly different positions, they are each exposed to a unique pressure drop which drives the flow in that particular lane. Furthermore, each lane has a different applied downstream pressure (P3) at which the flow direction in the lane will change and cells will be released. This difference allows for the independent release of single cells from each lane by gradually increasing the baseline pressure applied to P3 after a particular lane of interest is fully cleared (starting with the lowest lane and working up the array). The ability to collect single cells across many different lanes increases the throughput of each trap array.

The ability to release one cell at a time for downstream characterization presents the first means of enabling high depth measurements (such as qPCR or RNA-seq) on single cells with prior knowledge of their lineage relationships as measured in the trap array. Furthermore, the ability to release single cells from the trap arrays enables the isolation of single cell clones based on a functional readout of interest. This is particularly useful for adherent cells for which there are no efficient methods of isolating single cells after long term measurements of phenotype.

Figure 3A:
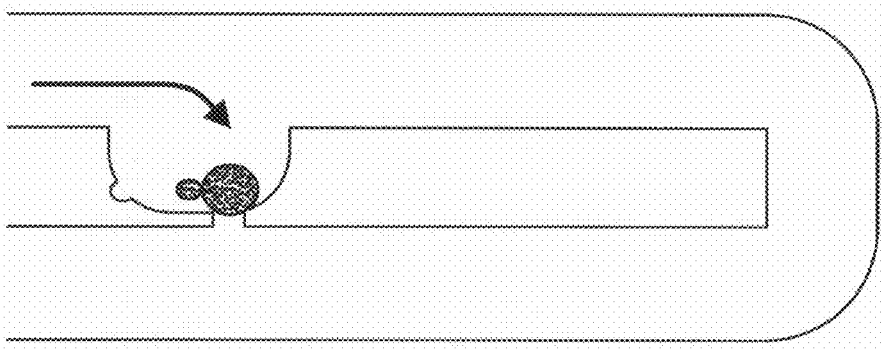
FIGS. 3*a, b* and *c* are schematic illustrations of a co-culture method disclosed herein.
Figure 3B:
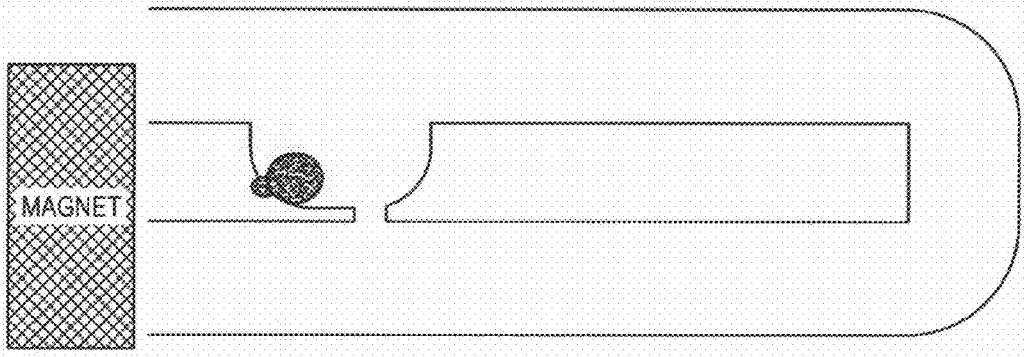
Figure 3C:
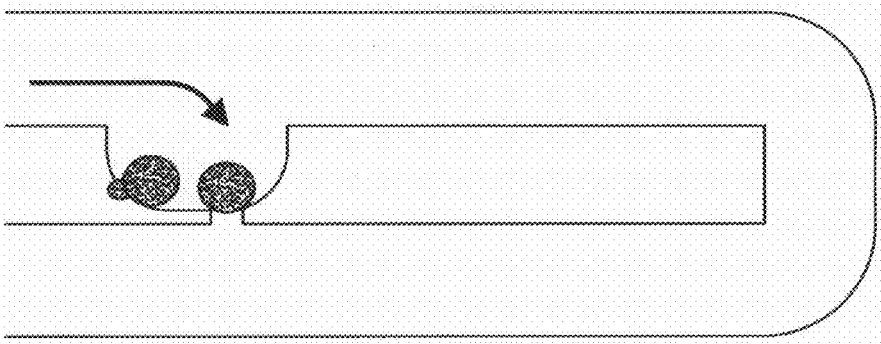

After loading a set of cells in to an array of hydrodynamic traps the resistance of each trap is such that most subsequent flow is directed to the bypassing serpentine channel. However, if upon loading a first round of cells the hydrodynamic resistances are re-set such that a majority of the flow is once again directed through the trap another round of a different type of cell can be loaded in to the traps. This re-establishment of resistances can be accomplished for suspension cells with functionalized magnetic beads directed against a surface protein of the first cell type. Once the cells are captured in the traps, they can be shifted from the trap opening with an external magnetic field acting on the functionalized beads (FIG. 3). This will reset the hydrodynamic resistances to allow for a one-to-one co-culture of two different cell types. In the case of adherent cells, a first cell type can be loaded and subsequently left to adhere to the channel surface. Once the cell adheres and flattens to the bottom surface of the channel the trap opening will once again decrease in resistance and allow for the capture of a second cell type.

Figure 4A:
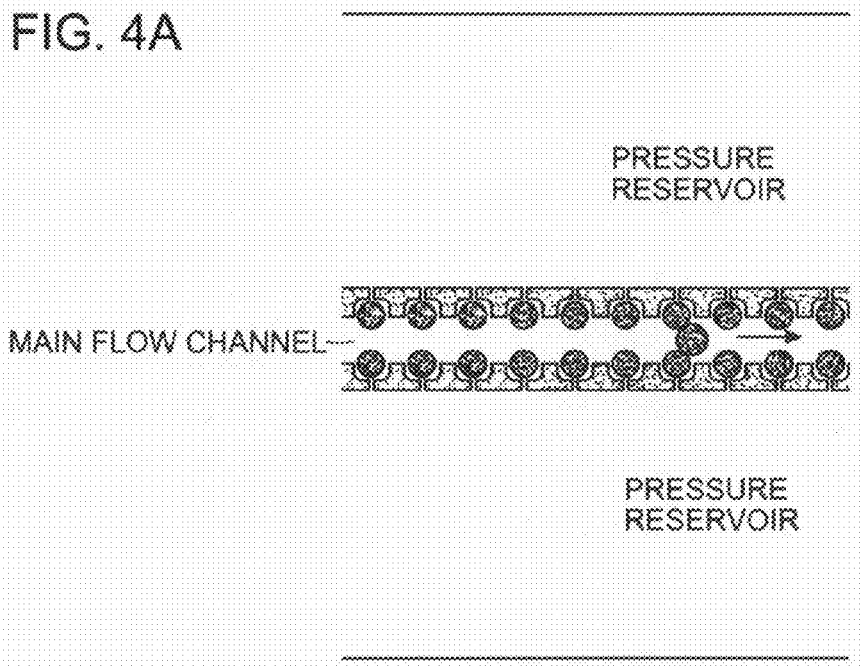
FIGS. 4*a* and *b* are schematic illustrations of traps for monitoring cell-cell interactions.
Figure 4B:
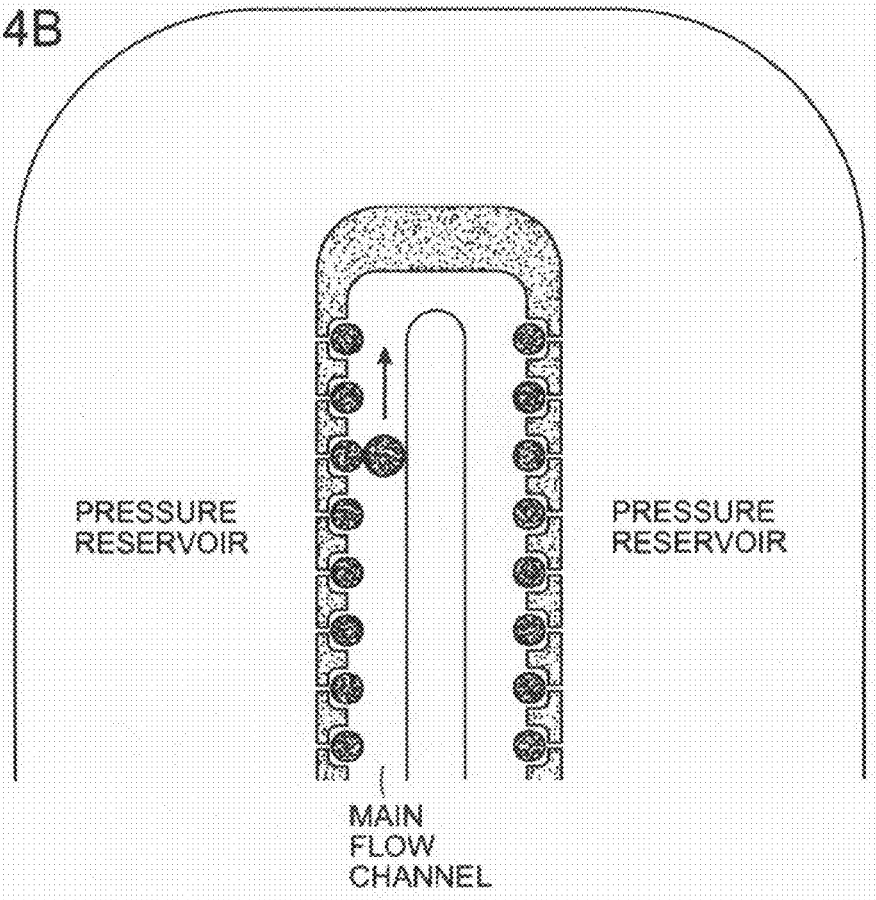

The traps can also be used to probe cell-cell interactions in a format similar to a chromatographic column. This is accomplished by either of the following methods: (a) arranging the traps in series in a single straight channel that is flanked by two larger pressure reservoir channels; or (b) arranging the traps in a curved channel that is flanked by a single pressure reservoir channel (FIG. 4). Cells of a first type are loaded into the traps using a pressure drop between the main flow channel and the pressure reservoirs. This pressure drop is maintained for the duration of an experiment; to ensure that the cells remain trapped, the pressure in the reservoirs is lower than that of the outlet of the main channel. Once the cells are trapped, they may be exposed to any of a variety of experimental conditions, including stimulating or inhibitory proteins or viral particles. Cells of a second type are then flowed through the main channel, and their interactions with the trapped cells are observed optically. At the end of an experiment, trapped cells are released by increasing the pressure in the reservoirs, such that the point of lowest pressure is at the outlet of the main flow channel. In addition to cells of both prokaryotic and eukaryotic origins, particles such as beads or hydrogels can also be loaded into the traps, and evaluated for interactions either with other particles or with cells.

What is claimed is:

1. Array of microfluidic hydrodynamic traps comprising:

a serpentine bypassing channel including a plurality of trapping pockets disposed therein, each of the trapping pockets including a ramp entry portion to decrease flow velocity orthogonal to the trapping pocket to increase trapping efficiency and each of the trapping pockets including an exit portion in fluid communication with an adjacent serpentine bypassing channel and wherein the relative fluid resistances through the trapping pockets and the serpentine bypassing channel are such that a majority of the flow is diverted to one of the trapping pockets; and a pair of microfluidic bypass channels flanking the array of traps and in fluid communication therewith through a branch substantially orthogonal to the bypass channels allowing independent control of upstream and downstream pressures on each side of the array, thereby decoupling flow magnitude in the bypass channels from flow across the trapping pockets.

2. The array of claim 1 further including a PEG layer on surfaces of the serpentine bypassing channels.

3. The array of claim 1 wherein surfaces of the serpentine bypassing channel are native silicon.

* * * * *